US007261079B2

(12) United States Patent
Gunji et al.

(10) Patent No.: US 7,261,079 B2
(45) Date of Patent: Aug. 28, 2007

(54) OIL STRAINER SUPPORT STRUCTURE IN ENGINE

(75) Inventors: Toru Gunji, Saitama (JP); Hiroyuki Sugiura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/313,782

(22) Filed: Dec. 22, 2005

(65) Prior Publication Data

US 2006/0137940 A1 Jun. 29, 2006

(30) Foreign Application Priority Data

Dec. 27, 2004 (JP) ..... 2004-376323

(51) Int. Cl.
*F01M 1/02* (2006.01)

(52) U.S. Cl. ..... 123/196 R; 184/106

(58) Field of Classification Search ..... 123/196 R, 123/195 C, 195 R; 184/106, 6.5
See application file for complete search history.

(56) References Cited

U.S. PATENT DOCUMENTS 6,523,561 B2 * 2/2003 Kapcoe et al. ..... 137/15.01

FOREIGN PATENT DOCUMENTS

JP 3-54219 U 5/1991

* cited by examiner

*Primary Examiner*—Stephen K. Cronin
*Assistant Examiner*—Hyder Ali
(74) *Attorney, Agent, or Firm*—Birch, Stewart, Kolasch & Birch, LLP

(57) ABSTRACT

In an engine wherein an upper end portion of a casing of an oil strainer disposed within an oil pan is supported on a crank case side and a suction port is formed in a lower end of the casing whose lower portion is formed in a funnel shape, the oil strainer is supported firmly while preventing an increase in weight and size of the engine and an increase in the number of parts. A plurality of vertically long plate-like strainer support portions are integrally formed on a lower side face of a casing of an oil strainer for abutting against and for being supported by the bottom of an oil pan.

20 Claims, 13 Drawing Sheets

OIL STRAINER SUPPORT STRUCTURE IN ENGINE

CROSS-REFERENCE TO RELATED APPLICATIONS

The present application claims priority under 35 USC 119 to Japanese Patent Application No. 2004-376323 filed on Dec. 27, 2004 the entire contents of which are hereby incorporated by reference.

FIELD OF THE INVENTION

The present invention relates to an engine wherein an oil pan for the storage of oil to be fed to various portions of an engine body is joined to a lower portion of a crank case provided in the engine body. An upper end portion of a casing of an oil strainer disposed within the oil pan is supported on the crank case side. A suction port is formed in a lower end of the casing whose lower portion is formed in the shape of a funnel. More particularly, the present invention is concerned with an improvement of an oil strainer support structure.

DESCRIPTION OF BACKGROUND ART

Japanese Utility Model Laid-Open No. Hei 3-54219 discloses an engine wherein an oil strainer includes a casing whose lower portion is formed in a funnel shape and is disposed within an oil pan in such a manner that an upper end portion of the casing is supported on a crank case side.

In the case of an oil strainer having a casing whose lower portion is formed in a funnel shape, a suction port formed in a lower end of the casing is narrow, so that an oil sucking flow velocity around the lower portion of the casing is relatively high and it is necessary to enhance the support strength of the casing so as to withstand the high flow. According to the related art, in order to meet this requirement, the inside diameter of an oil passage in which an upper portion of an oil strainer is fitted and supported is made large or the peripheral portion of the oil passage is thick-walled, or the oil strainer is supported by a stay which is mounted to the crank case. However, such structures result in an increase in the weight and the size of the engine. More particularly, in the case where the oil strainer is supported by a stay, not only an increase in the number of parts results, but also the layout is restricted for example by a partition wall disposed within the oil pan.

SUMMARY AND OBJECTS OF THE INVENTION

The present invention has been accomplished in view of the above-mentioned circumstances. One embodiment of the present invention provides an oil strainer support structure in an engine which not only can avoid an increase in the weight and the size of an engine and prevent an increase in the number of parts but also can strongly support an oil strainer.

For achieving the above-mentioned desire, according to an embodiment of the present invention, there is provided an oil strainer support structure in an engine wherein an oil pan for the storage of oil to be fed to various portions of an engine body is joined to a lower portion of a crank case provided in the engine body, an upper end portion of a casing of an oil strainer disposed within the oil pan is supported on the crank case side, and a suction port is formed in a lower end of the casing whose lower portion is formed in the shape of a funnel. A plurality of vertically long plate-like strainer support portions are integrally formed on a side face of the lower portion of the casing of the oil strainer and are each abutted against and supported by a bottom of the oil pan.

According to an embodiment of the present invention, the strainer support portions are formed to include a large projection from the casing toward the lower side.

According to an embodiment of the present invention, the strainer support portions are disposed in a pair in the longitudinal direction of a vehicle on which the engine body is mounted and also in a pair in the transverse direction of the vehicle.

According to an embodiment of the present invention, both right and left sides of the oil pan are formed in a generally V-shape having a narrow lower portion when looking in an advancing direction of a motorcycle on which the engine body is mounted, and a plurality of strainer support portions are integrally formed on a side face of the lower portion of the casing. The strainer support portions include at least such strainer support portions as are disposed at least partially between both right and left sides of the casing and both right and left sides of the oil pan.

According to an embodiment of the present invention, since a plurality of vertically long plate-like strainer support portions are integrally formed on a side face of the casing lower portion and are abutted against and supported by the bottom of the oil pan, the strength of the casing lower portion can be enhanced by allowing each strainer support portion to fulfill the function of a reinforcing rib. In addition, the support strength of the oil strainer can be enhanced while making it unnecessary to specially enhance the support strength on the crank case side which supports the upper end portion of the oil strainer. Thus, it is possible to strongly support the oil strainer while avoiding an increase in the size and the weight of the engine and an increase in the number of parts. Moreover, since each strainer support portion also fulfills the function of a partition wall which restricts the movement of oil within the oil pan, it is unnecessary to dispose any other partition wall than the oil strainer within the oil pan, whereby it is also possible to decrease the number of parts.

According to an embodiment of the present invention, since each strainer support portion is formed so as to include a larger projection from the casing toward the lower side, the flow of oil can be made uniform effectively in the vicinity of the suction port and it is possible to keep the suction resistance of oil low into the suction port for improving the suction efficiency.

According to an embodiment of the present invention, the movement of oil within the oil pan caused by a sudden acceleration or deceleration of the vehicle or caused by movement in the transverse direction of the vehicle can be restricted effectively by the strainer support portions.

According to an embodiment of the present invention, longitudinal movements of oil between the right and left side walls of the generally V-shaped oil pan having a narrow lower portion and the oil strainer caused by a sudden acceleration or deceleration of the motorcycle can be prevented effectively by the strainer support portions which are disposed at least partially between both the right and left sides of the casing and both the right and left sides of the oil pan.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will be described hereinafter with reference to the accompanying drawings.

FIGS. 1 to 12 illustrate a first embodiment of the present invention.

Figure 1:
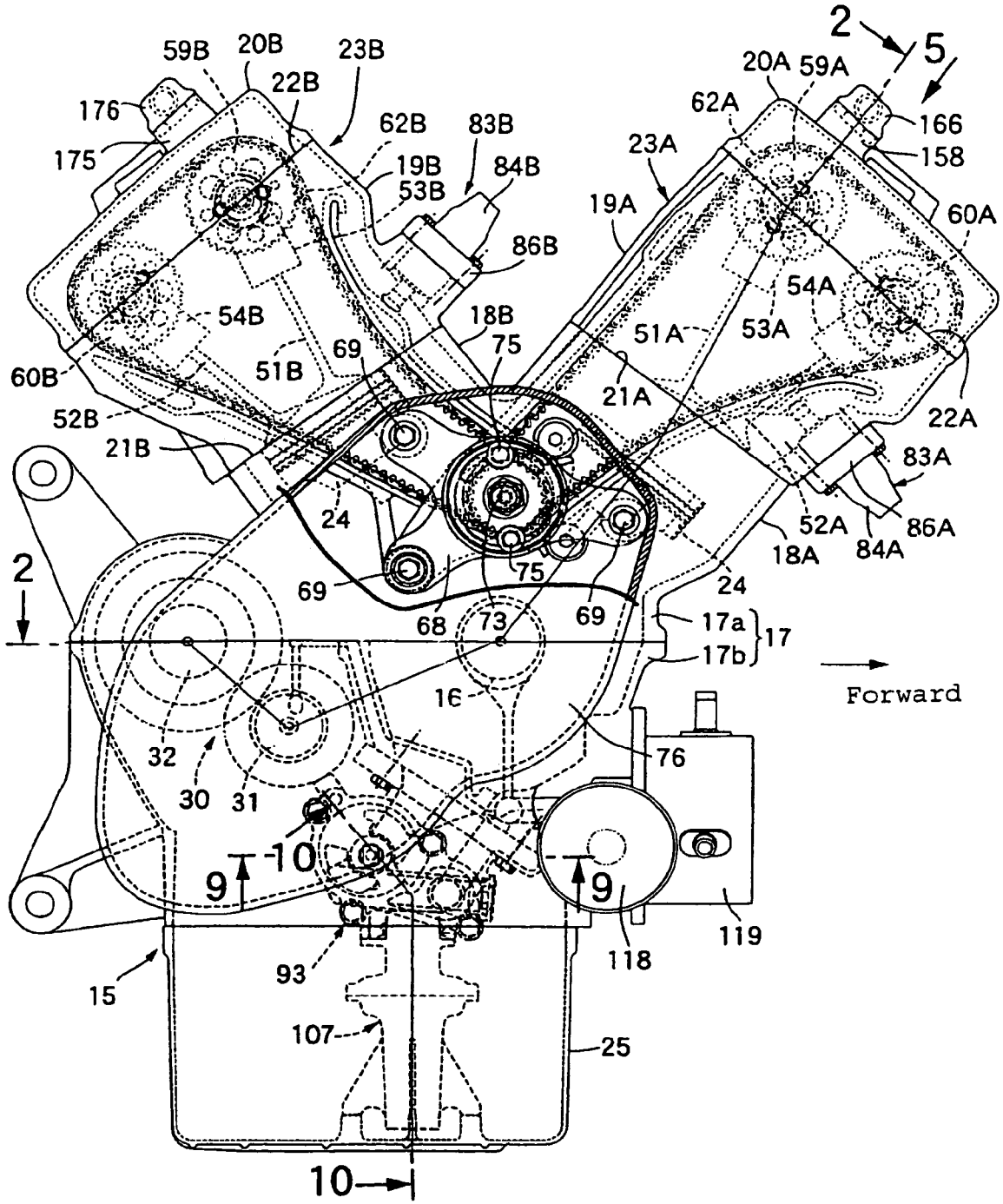
FIG. 1 is a partially cut-away side view of a V-type engine according to a first embodiment of the present invention.

Referring first to FIG. 1, a V-type engine of, say, five cylinder is mounted on a vehicle, e.g., a motorcycle. An engine body 15 of the engine includes a crank case 17 which rotatably supports a crank shaft 16 having an axis extending in the transverse direction of the motorcycle. A first cylinder block 18A is joined to the crank case 17 on a front side in a motorcycle advancing direction with a first cylinder head 19A being joined to an upper-end joining surface 21A of the first cylinder block 18A and a first head cover 20A being joined to an upper-end joining surface 22A of the first cylinder head 19A. A second cylinder block 18B is joined to the crank case 17 on a rear side in the motorcycle advancing direction with a second cylinder head 19B being joined to an upper-end joining surface 21B of the second cylinder block 18B, and a second head cover 20B being joined to an upper-end joining surface 22B of the second cylinder head 19B.

The crank case 17 includes an upper case 17*a* and a lower case 17*b* joined to each other. The crank shaft 16 is supported rotatably between the upper case 17*a* and the lower case 17*b*. In addition, the first and second cylinder blocks 18A, 18B are formed integrally with the upper case 17*a*.

A first bank 23A of three cylinders is constituted by the first cylinder block 18A, the first cylinder head 19A and the first head cover 20A. A second bank 23B of two cylinders, which forms an upwardly open V-shape conjointly with the first bank 23A, is constituted by the second cylinder block 18B, the second cylinder head 19B and the second head cover 20B.

Figure 2:
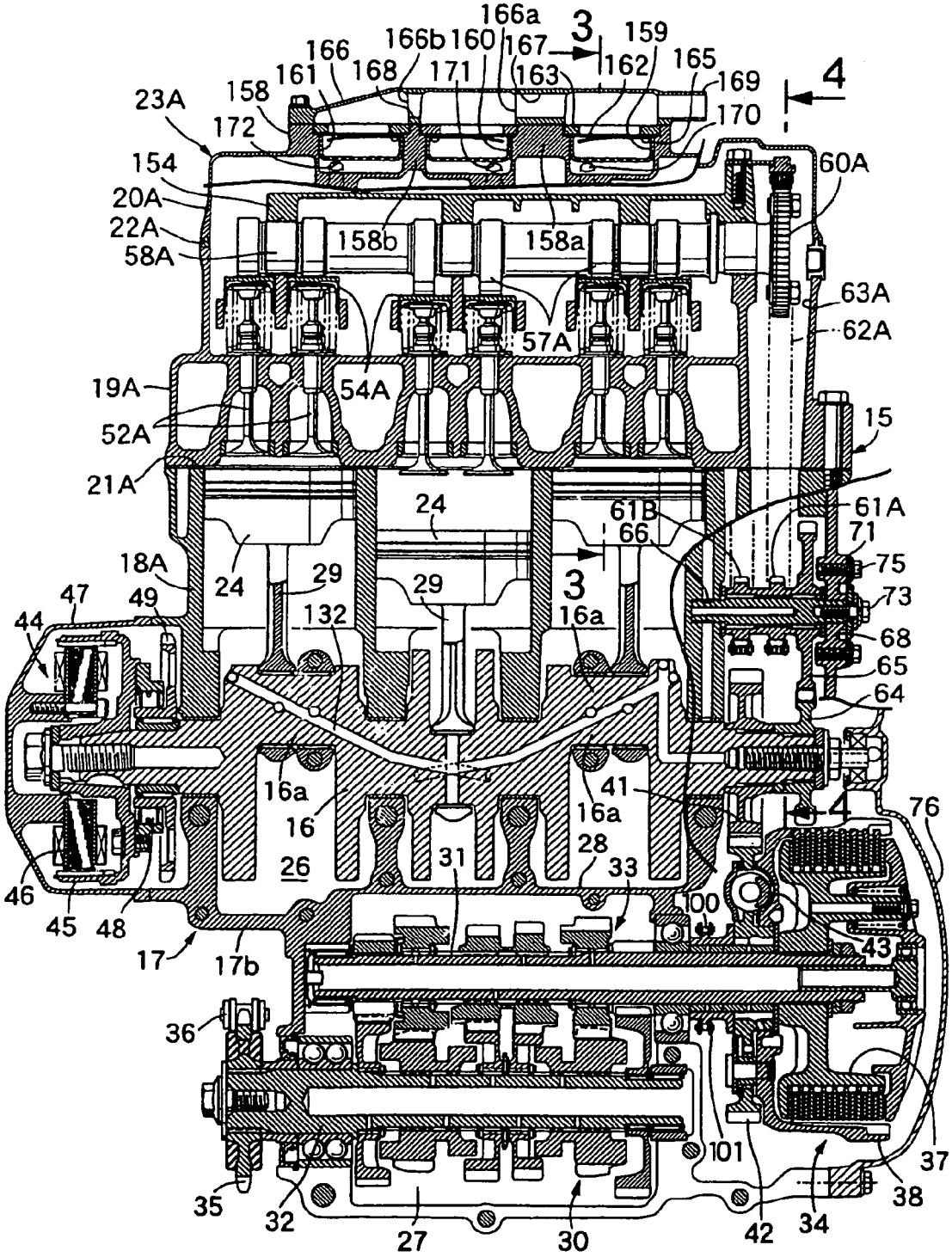
FIG. 2 is a sectional view taken on line 2-2 in FIG. 1.

Referring also to FIG. 2, three pistons 24 are arranged axially of the crank shaft 16 and are slidably fitted into the first cylinder block 18A of the first bank 23A, while two pistons 24 are arranged axially of the crank shaft 16 and are slidably fitted into the second cylinder block 18B of the second bank 23B. The pistons 24 in both banks 23A and 23B are connected in common to crank pins 16*a* of the crank shaft 16 through connecting rods 29.

An oil pan 25 is joined to a lower portion of the crank case 17, i.e., a lower portion of the lower case 17*b*. A partition wall 28 is provided in the crank case 17 for partitioning between a crank chamber accommodating the greater part of the crank shaft 16 and a transmission chamber 27. The transmission chamber 27 is formed by the crank case 17 and the oil pan 25 so as to be positioned on rear and lower sides of the crank chamber 26.

A constant mesh type gear transmission 30 is accommodated within the transmission chamber 27 on the rear side of the crank chamber 26. The gear transmission 30 includes a main shaft 31 having an axis parallel to the crank shaft 16 and supported rotatably by the lower case 17*b* of the crank case 17. A counter shaft 32 is provided having an axis parallel to the main shaft 31 and supported rotatably between the upper and lower cases 17*a*, 17*b* of the crank case 17. A plurality of shift ranges, e.g., six shift ranges, of gear train groups 33 are capable of being engaged selectively and are disposed between the main shaft 31 and the counter shaft 32. Power from the crank shaft 16 is inputted to one end portion of the main shaft 31 through a clutch 34. A driving sprocket 35 is fixed to an end portion of the counter shaft 32 projecting from the left side wall of the crank case 17 in a state facing in the motorcycle advancing direction. The chain 36 is wound to the driving sprocket so as to transmit driving power to the rear wheel not shown in figures.

The clutch 34 is a known multiple disc clutch provided with a clutch inner 37 incapable of relative rotation with respect to the main shaft 31 and a clutch outer 38 capable of relative rotation with respect to the main shaft 31.

One end portion of the crank shaft 16 projects from the right side wall of the crank case 17 in a state facing the front side in the motorcycle advancing direction. A primary driving gear 41 of a relatively large diameter is fixed to one end portion of the crank shaft 16 outside the crank case 17 and a primary driven gear 42, meshing with the primary driving gear 41, is connected to the clutch outer 38 of the clutch 34 through a damper spring 43.

An opposite end portion of the crank shaft 16 projects from the left side wall of the crank case 17 in a state facing the front side in the motorcycle advancing direction and an outer rotor 45 of a generator 44 is fixed to the opposite end portion of the crank shaft 16. Moreover, an inner stator 46 which constitutes the generator 44 together with the outer rotor 45 is fixed to a generator cover 47 which is joined to the left side wall of the crank case 17 so as to cover the generator 44. Further, a gear 49 is connected to the outer rotor 45 through a one-way clutch 48 and it is interlocked with a starting motor (not shown).

Figure 3:
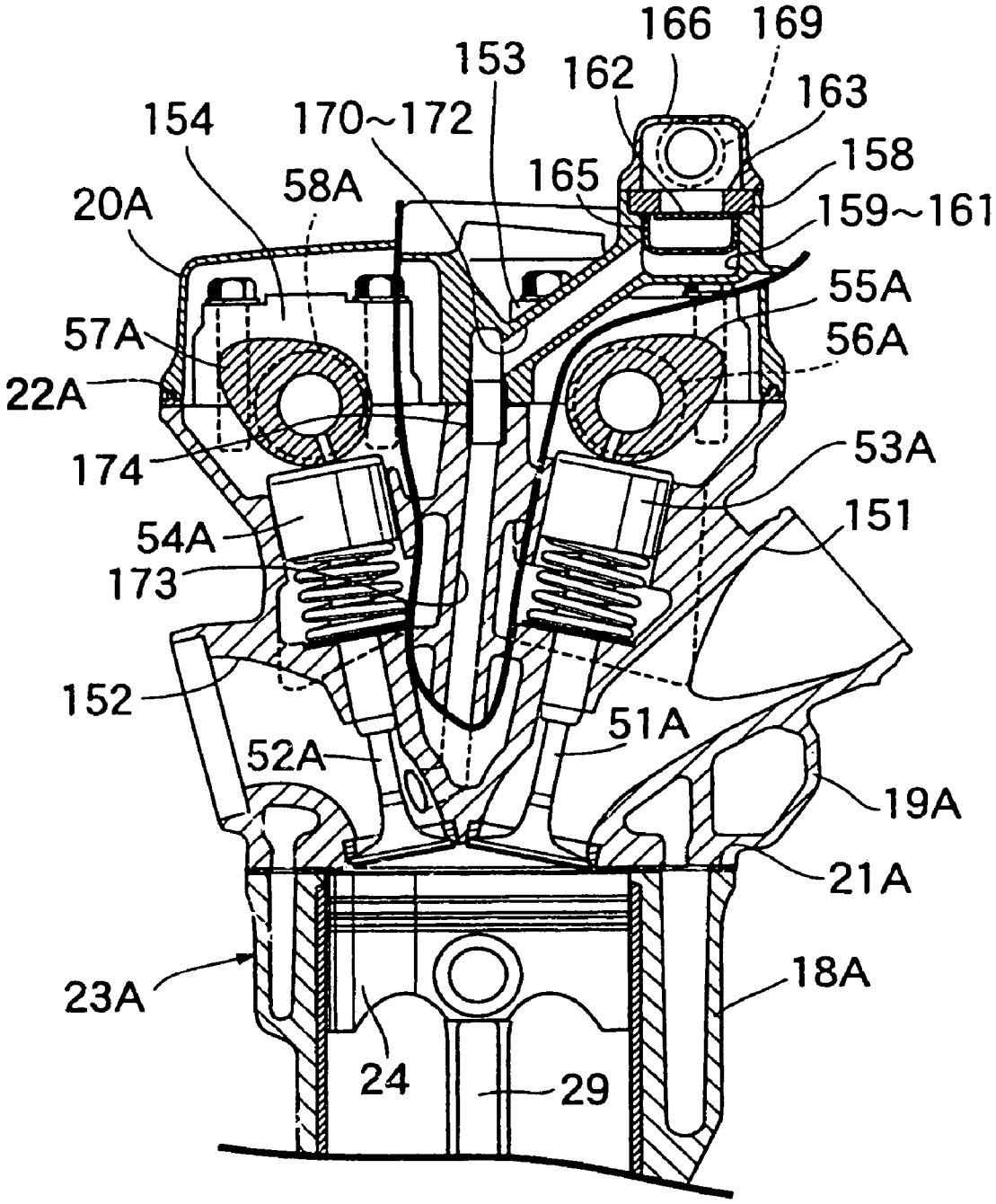
FIG. 3 is a sectional view taken on line 3-3 in FIG. 2.

In the first cylinder head 19A of the first bank 23A, as shown in FIG. 3, intake ports 151 which are open inwards of both banks 23A and 23B and exhaust ports 152 which are open to side walls opposite to the intake ports 151 are provided for each cylinder. A pair of intake valves 51A and a pair of exhaust valves 52A are disposed in the first cylinder head 19A, respectively, for the intake ports 151 and the exhaust ports 152 in such a manner that they can be opened and closed while being biased in a valve closing direction by means of springs. Moreover, bottomed cylindrical intake valve-side lifters 53A having closed end inner surfaces abutting, respectively, against the tops of the intake valves 51A and bottomed cylindrical exhaust valve-side lifters 54A having closed end inner surfaces abutting, respectively, against the tops of the exhaust valves 52A are fitted in the first cylinder head 19A so that they can slide in the opening and closing directions of the intake valves 51A and the exhaust valves 52A.

An intake-side cam shaft 56A includes a plurality of intake-side cams 55A which are in sliding contact with closed end outer surfaces of the intake valve-side lifters 53A and is supported rotatably about an axis parallel to the crank shaft 16 by means of the first cylinder head 19A and an intake-side cam holder 153 clamped to the first cylinder head 19A. Likewise, an exhaust-side cam shaft 58A includes a plurality of exhaust-side cams 57A which are in sliding contact with closed end outer surfaces of the exhaust valve-side lifters 54A and is supported rotatably about an axis parallel to the crank shaft 16 by means of the first cylinder head 19A and an exhaust-side cam holder 154 clamped to the first cylinder head 19A.

Figure 4:
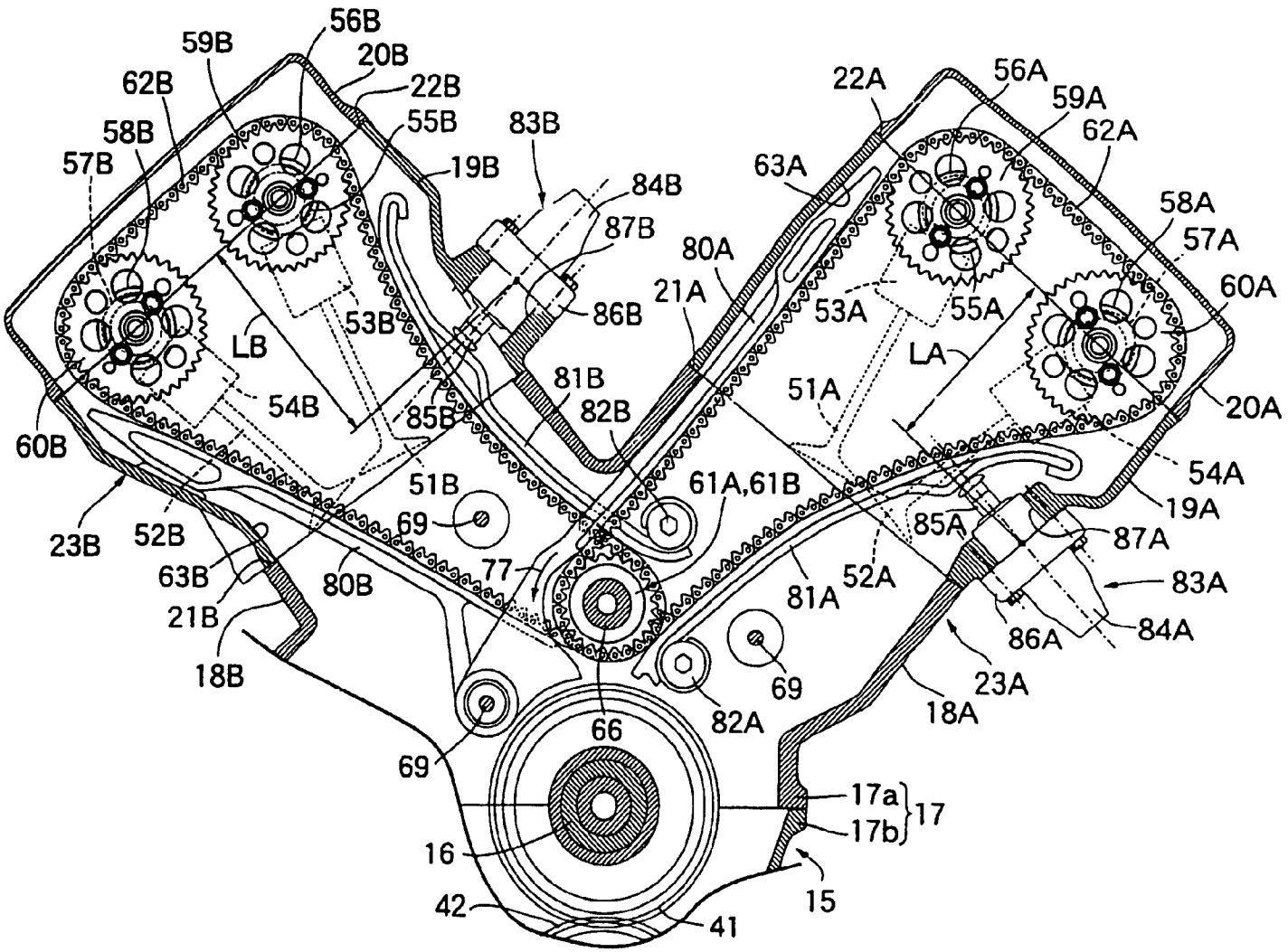
FIG. 4 is a sectional view taken on line 4-4 in FIG. 2.

Referring to FIG. 4, intake valves 51B and exhaust valves 52B each in a pair are disposed for each cylinder in the second cylinder head 19B of the second bank 23B so that they can be opened and closed while being biased in a valve closing direction by means of springs. Intake-side cams 55B on an intake-side cam shaft 56B which is rotatable about an axis parallel to the crank shaft 16 are placed in sliding contact with intake valve-side lifters 53B abutted against the tops of the intake valves 51B. Likewise, exhaust-side cams 57B on an exhaust-side cam shaft 58B which is rotatable about an axis parallel to the crank shaft 16 are placed in sliding contact with exhaust valve-side lifters 54B abutted against the tops of exhaust valves 52B.

Figure 5:
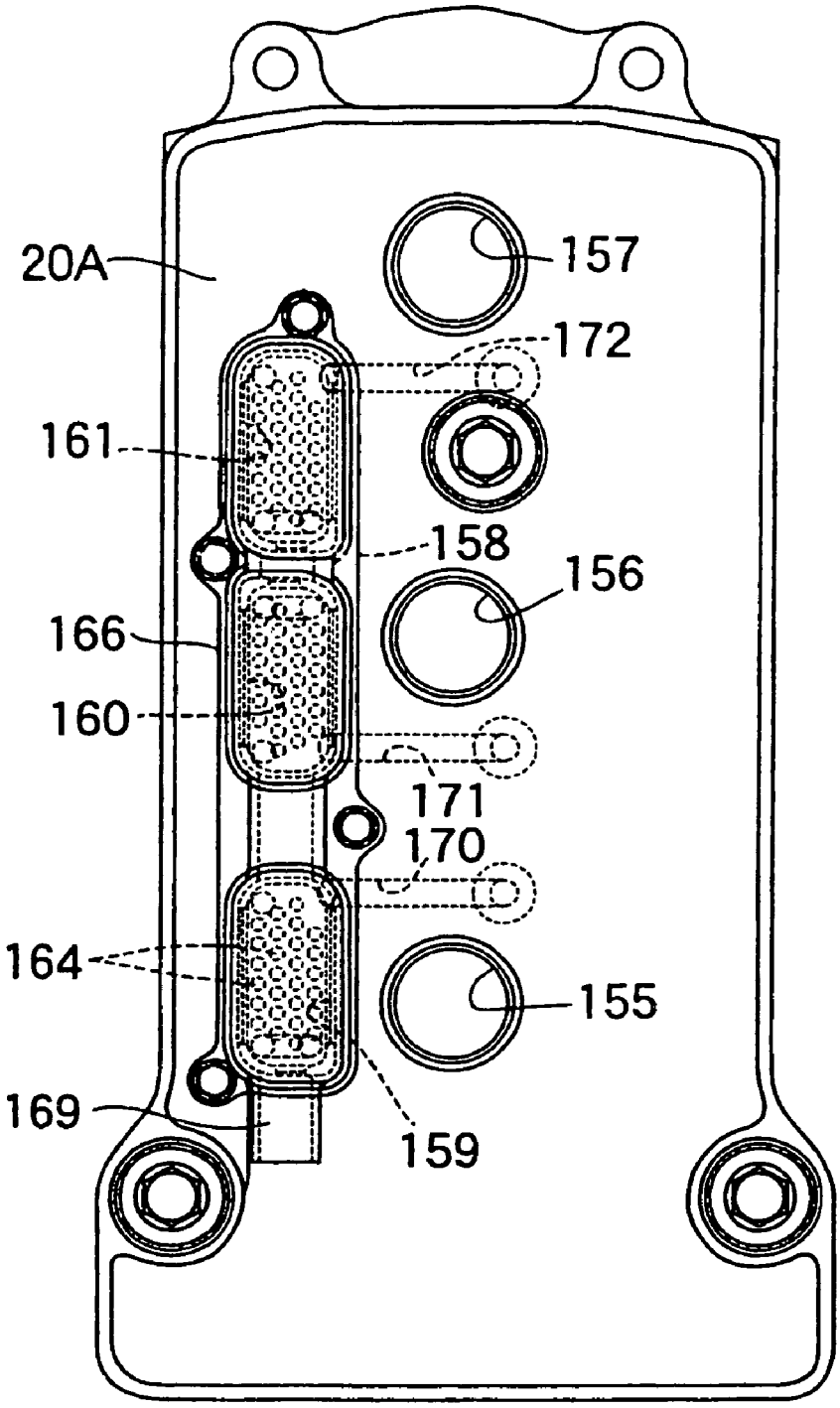
FIG. 5 is a view as seen in the direction of arrow 5 in FIG. 1.

In FIG. 5, three plug insertion holes 155, 156 and 157 for insertion therein of spark plugs (not shown) at positions corresponding to the centers of the cylinders are formed in the first head cover 20A of the first bank 23A at equal intervals in order from right to left in a state facing the front side in the motorcycle advancing direction. Further, a mounting cylindrical portion 158 having a long cross-sectional shape in the arranged direction of the plug insertion holes 155 to 157 are integrally provided projectingly on an upper surface of the first head cover 20A and on a side to the rear as compared to the plug insertion holes 155 to 157. Within the mounting cylindrical portion 158 are formed three mounting recesses 159, 160 and 161 in order from the right side in a state facing the front side in the motorcycle advancing direction. The mounting recesses 159, 160 and 161 are formed in such a manner that partition walls 158*a* and 158*b* having upper surfaces flush with an upper surface of a side wall of the mounting cylindrical portion 156 are formed between adjacent such recesses.

The mounting recesses 159 and 160 out of the mounting recesses 159 to 161 are formed at positions substantially corresponding to the plug insertion holes 155 and 156, while the mounting recess 161 is disposed at a position substantially corresponding to an intermediate portion between the plug insertion holes 156 and 157. That is, the distance between the mounting recess 160 which lies at an intermediate position of the mounting recesses 159 to 161 and the mounting recess 159 positioned on the right side of the mounting recess 160 is set larger than the distance between the mounting recess 160 which lies in the intermediate position and the mounting recess 161 positioned on the left side of the mounting recess 160. The mounting recesses 160 and 161 are positioned in proximity to each other.

A ring-like support member 163 with a reed valve 162 attached thereto is press-fitted in each of the mounting recesses 159 to 161 and a bottomed cylindrical protecting member 165 having a plurality of small holes 164 (see FIG. 4) is press-fitted in each of the mounting recesses 159 to 161 so as to be positioned inside with respect to the reed valve 162.

A cap 166 is clamped to the mounting cylindrical portion 158 so as to cover the mounting cylindrical portion 158 from above. As shown in FIG. 2, the cap 166 is provided with partition walls 166*a* and 166*b* which are put in abutment against the partition walls 158*a* and 158*b* of the mounting cylindrical portion 158 from above. Coaxial communication holes 167 and 168 are formed in the partition walls 166*a* and 166*b*. Further, a connecting cylindrical portion 169 extending coaxially with the communication holes 167 and 168 integrally project from the cap 166, and a conduit (not shown) for the introduction of secondary air is connected to the connecting cylindrical portion 169. That is, secondary air is introduced between the cap 166 and the mounting cylindrical portion 158.

Secondary air passages 170, 171 and 172 are formed in the first head cover 20A so as to be open to inner surfaces of closed ends of the mounting recesses 159 to 161. The second air passages 170 and 171 are positioned between the plug insertion holes 155 and 156, while the secondary air passage 172 is positioned between the plug insertion holes 156 and 157.

On the other hand, as shown in FIG. 3, secondary air passages 173 extending upwardly are formed in the first cylinder head 19A in such a manner that their lower ends are open to the exhaust ports 152 in the cylinders. Upper ends of the secondary air passages 173 communicate, respectively, with the secondary air passages 173 in the first head cover 20A through connecting pipes 174 which are held grippingly between the first head cover 20A and the first cylinder head 19A so as to serve also as positioning pins.

According to this secondary air supply structure on the first bank 23A side, the connecting cylindrical portion 158 provided on the first head cover 20A and the cap 166 attached to the connecting cylindrical portion 158 can be made compact.

In the second bank 23B, as shown in FIG. 1, a connecting cylindrical portion 175 is provided that projects from the second head cover 20B to supply secondary air to two cylinders located on the second bank 23B side, and a cap 176 is attached to the connecting cylindrical portion 175. Although the shape of the connecting cylindrical portion 175 and that of the cap 176 are different from those of the connecting cylindrical portion 168 and the cap 166 located on the first bank 23A side, a reed valve disposing structure and a passage structure for conducting secondary air from the reed valves to the exhaust ports are the same as those on the first bank 23A side.

Referring to FIG. 4, intake-side and exhaust-side driven sprockets 59A, 60A are fixed to one end portions of the intake-side and exhaust-side cam shafts 56A and 58B in the first bank 23A, while intake-side and exhaust-side driven sprockets 59B, 60B are fixed to one end portions of the intake-side and exhaust-side cam shafts 56B, 58B in the second bank 23B.

A driving sprocket 61A on the first bank side and a driving sprocket 61B on the second bank side, which are each adapted to rotate about an axis parallel to the crank shaft 16, are disposed outside the right side wall in the crank case 17 and above one end portion of the crank shaft 16. An endless cam chain 62A is wound on the intake-side and exhaust-side driven sprockets 59A, 60A on the first bank 23A side and also on the driving sprocket 61A on the first bank side. A chain passage 63A for travel of the cam chain 62A is formed in the first cylinder block 18A, first cylinder head 19A and first head cover 20A of the first bank 23A and on one end side of the crank shaft 16. An endless cam chain 62B is wound on the intake-side and exhaust-side driven sprockets 59B, 60B on the second bank 23B side and also on the driving sprocket 61B on the second bank side. Further, a chain passage 63B for travel of the cam chain 62B is formed in the second cylinder block 18B, second cylinder head 19B and second head cover 20B of the second bank 23B on one end side of the crank shaft 16.

Figure 6:
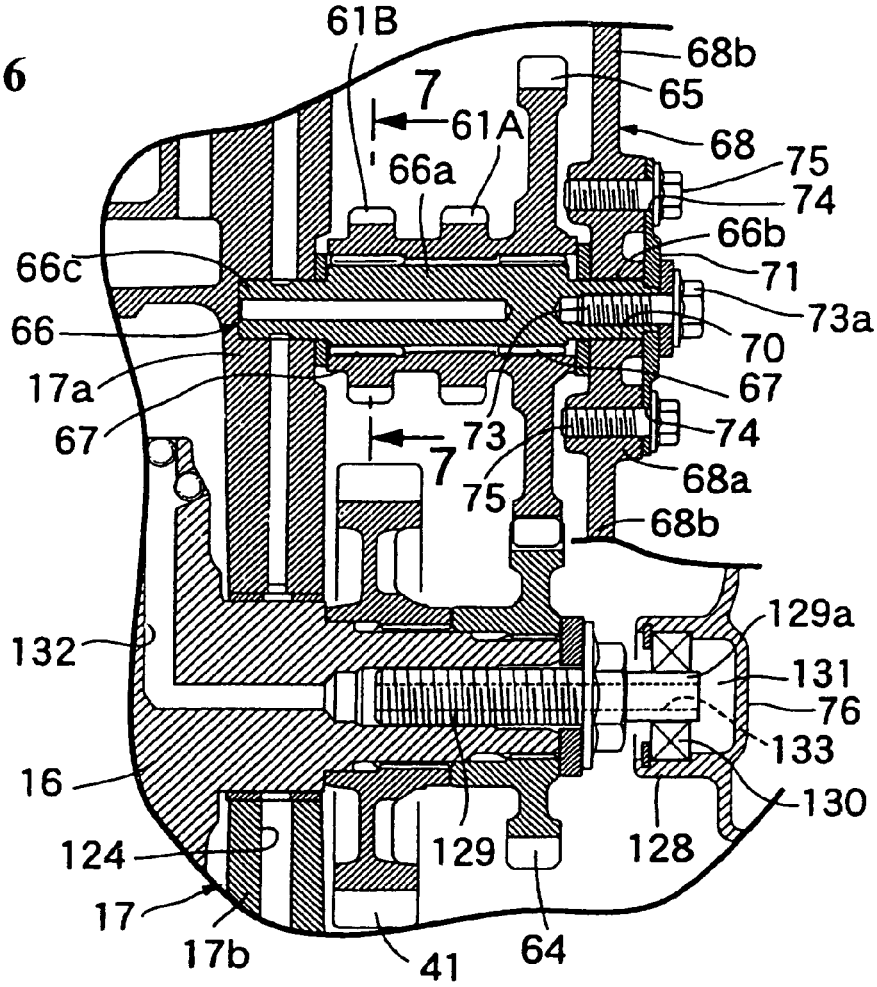
FIG. 6 is an enlarged view of a principal portion of FIG. 2.

Referring to FIG. 6, an idler driving gear 64 that is smaller in diameter than the primary driving gear 41 is formed on one end portion of the crank shaft 16 and is axially positioned to be outwards with respect to the primary driving gear 41 in such a manner that its outer periphery is opposed to the clutch 34 interposed between the crank shaft 16 and the gear transmission 30. An idle gear 65 meshing with the idler driving gear 64 is supported rotatably by an idle shaft 66 having an axis parallel to the crank shaft 16. In addition, the driving sprocket 61A on the first bank side and the driving sprocket 61B on the second bank side are coaxially provided axially inside the idle gear 65 and contiguously to the idle gear 65 in such a manner that their outer peripheries are opposed at least partially to the primary driving gear 41.

The driving sprocket 61A on the first bank side and the driving sprocket 61B on the second bank side are integral with the idle gear 65 which is a single gear common to both driving sprockets 61A and 61B. The intake-side and exhaust-side driven sprockets 59A, 60A are fixed, respectively, to the intake-side and exhaust-side cam shafts 56A, 58A on the first bank 23A side, the driving sprocket 61A on the first bank and the cam chain 62A, which are for driving the cam shafts 56A and 58A, as well as the intake-side and exhaust-side driven sprockets 59B, 60B fixed, respectively, to the intake-side and exhaust-side cam shafts 56B, 58B on the second bank 23B side, the driving sprocket 61B on the second bank side and the cam chain 62B, which are for driving the cam shafts 56B and 58B, are disposed in mutually adjacent manner on one end side in the axial direction of the crank shaft 16.

Figure 7:
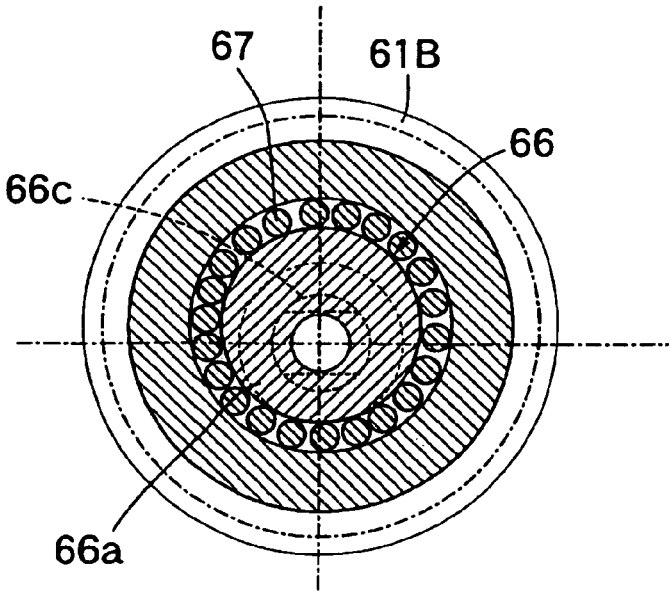
FIG. 7 is an enlarged sectional view taken on line 7-7 in FIG. 6.

Referring also to FIG. 7, the idle shaft 66 is integrally provided with an intermediate offset shaft portion 66*a* and support shaft portions 66*b* and 66*c* contiguous to both ends of the offset shaft portion 66*a* and having one and same axis offset from the axis of the offset shaft portion 66*a*. The idle gear 65, as well as the driving sprocket 61A on the first bank side and the driving sprocket 61B on the second bank side, are supported rotatably by the offset shaft portion 66*a* through a pair of needle bearings 67.

The idle shaft 66 is supported by the crank case 17 so as to be rotatable about the axes of the support shaft portions 66*b* and 66*c*, i.e., rotatable about an axis offset from the axis of the offset shaft portion 66*a*. The support shaft portion 66*b* on one end side of the idle shaft 66 is supported rotatably by a shaft bolder 68 which is clamped to the right side wall of the crank case 17 in a state facing the front side in the motorcycle advancing direction, while the support shaft portion 66*c* on the opposite end side of the idle shaft 66 is supported rotatably by the right side wall of the crank case 17.

Figure 8:
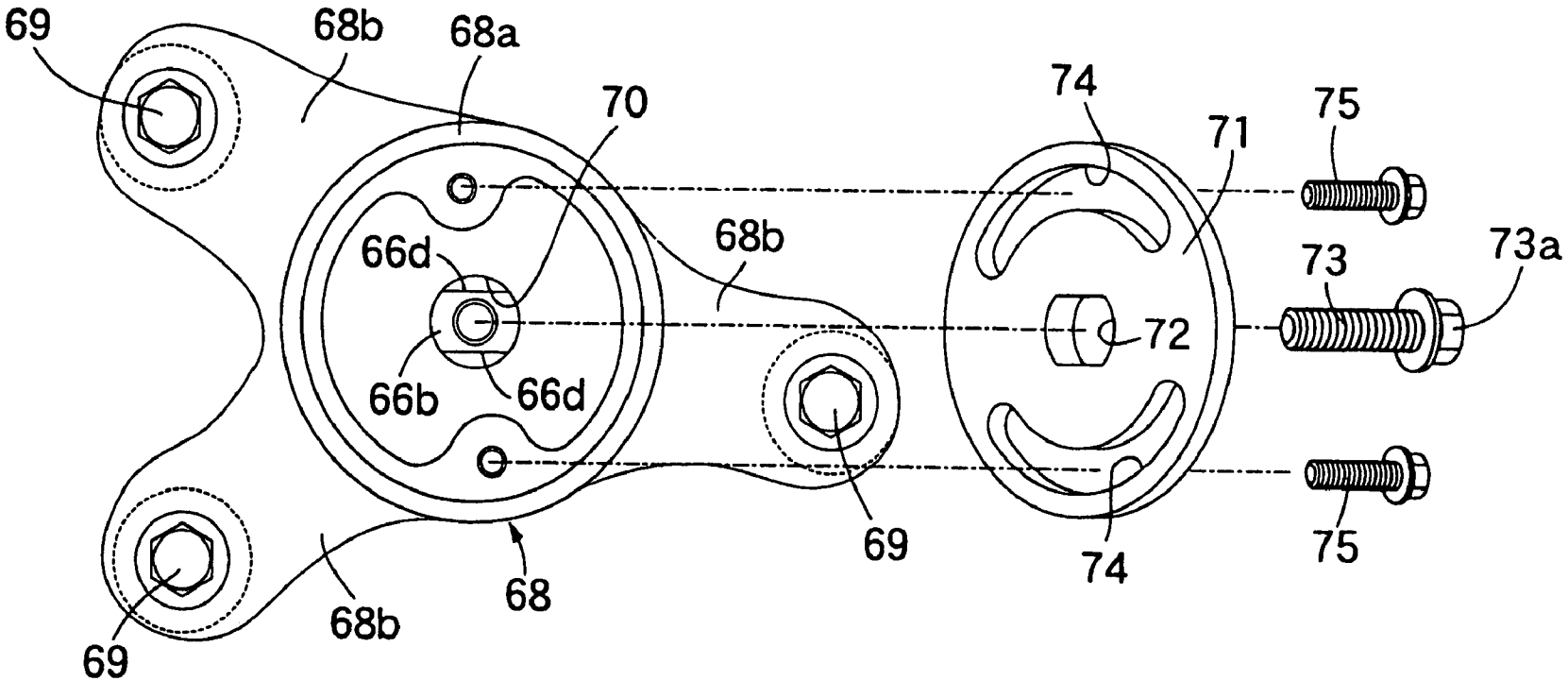
FIG. 8 is an exploded perspective view of a shaft holder and a restriction disc.

Referring to FIG. 8, the shaft holder 68 is integrally provided with a disc-like support portion 68*a* and support arm portions 68*b* projecting sideways and outwardly from a plurality of, say, three, circumferential positions, of the support portion 68*a*. Projecting ends of the support arm portions 68*b* are fixed to the right side wall of the crank case 17 with bolts 69 at positions not obstructing the travel of the cam chains 62A and 62B. A circular support hole 70 is formed centrally of the support portion 68*a* and the support shaft portion 66*b* located on one end side of the idle shaft 66 is fitted and rotatably supported in the support hole 70. In addition, a front end of the support shaft portion 66*b* located on one end side of the idle shaft 66 is formed in a non-circular cross sectional shape so as to have for example a pair of mutually parallel flat surfaces 66*d* on the outer periphery thereof.

A restriction disc 71 is disposed outside the support portion 68*a* in the shaft holder 68 and a restriction hole 72 for fitting therein the front end of the support shaft portion 66*b* in a relatively unrotatable manner is formed centrally of the restriction disc 71 so as to have a shape corresponding to the cross sectional shape of the front end of the support shaft portion 66*b*. Further, a bolt 73 is brought into threaded engagement with the support shaft portion 66*b* in such a manner that a head portion 73*a* of a larger diameter is engaged with the restriction disc 71. That is, the restriction disc 71 is fixed to the support shaft portion 66*b*.

A pair of arcuate elongated holes 74 centered on the axis of the support shaft portion 66*b* are formed in the restriction disc 71 in, say, two positions around the restriction hole 72 and a pair of bolts 75 are inserted into the elongated holes 74 and are brought into engagement with the support portion 68*a* of the shaft holder 68.

With the bolts 75 tightened, the idle shaft 66 is inhibited from rotating about the axis of the support shaft portions 66*b* and 66*c*, but by loosening the bolts 75 it becomes allowable for the idle shaft 66 to rotate about the axes of the support shaft portions 66*b* and 66*c*, that is, to rotate about an axis offset from the axis of the offset shaft portion 66*a*.

A cover 76 which not only covers the clutch 34 but also covers one end portion of the crank shaft 16 and the shaft holder 68 is joined to the right side wall of the crank case 17 contiguously to the cylinder blocks 18A and 18B of the first and second banks 23A, 23B.

Referring to FIG. 4, the driving sprocket 61A on the first bank side and the driving sprocket 61B on the second bank side are adapted to rotate in the direction of arrow 77. On the first bank 23A side, the portion corresponding to between the first bank-side driving sprocket 61A and the exhaust-side driven sprocket 60A on the cam chain 62A, i.e., the portion corresponding to the outside of both banks 23A and 23B, is a slack side, while the portion corresponding to between the intake-side driven sprocket 59A and the first bank-side driving sprocket 61A on the cam chain 62A, i.e., the portion corresponding to the inside of both banks 23A and 23B, is a tension side. On the second bank 23B side, the portion corresponding to between the second bank-side driving sprocket 61B and the exhaust-side driven sprocket 60B on the cam chain 62B, i.e., the portion corresponding to the outside of both banks 23A and 23B, is a slack side, while the portion corresponding to between the intake-side driven sprocket 59B and the second bank-side driving sprocket 61B on the cam chain 62B, i.e., the portion corresponding to the inside of both banks, is a tension side.

Attached to the crank case 17 are a chain guide member 80A which is in contact with the tension-side outer periphery of the cam chain 62A on the first bank 23A side, a chain tensioner 81A which is in contact with the slack-side outer periphery of the cam chain 62A on the first bank 23A side, a chain guide member 80B which is in contact with the tension-side outer periphery of the cam chain 62B on the second bank 23B side, and a chain tensioner 81B which is in contact with the slack-side outer periphery of the cam chain 62B on the second bank 23B side.

End portions of the chain guide members 80A and 80B are disposed in a mutually superimposed manner at an obliquely downward position near the first and second bank-side driving sprockets 61A and 61B. One of bolts 69 sandwiched in between one of three support arm portions 68*b* of a shaft holder 68 which supports the idle shaft 66 and the crank case 17, the bolts 69 clamping the three support arm portions 68*b* to the crank case 17, passes through one end portion of the mutually superimposed chain guide members 80A and 80B. In addition, upper portions of both chain guide members 80A and 80B are abutted against and supported by inner walls of the first and second cylinder heads 19A and 19B in both banks 23A and 23B.

The chain tensioner 81A on the first bank 23A side is formed in a bow shape so that a convexly curved surface thereof comes into sliding contact with the slack-side outer periphery of the cam chain 62A at the portion corresponding to the outside of both banks 23A and 23B. Likewise, the chain tensioner 81B on the second bank 23B side is formed in a bow shape so that a convexly curved surface thereof comes into sliding contact with the slack-side outer periphery of the cam chain 62B at the portion corresponding to the inside of both banks 23A and 23B. One end portion on the crank shaft 16 side of the chain tensioners 81A and 81B is supported in the crank case 17 pivotably through pivot shafts 82A and 82B.

For imparting tension to the slack side of the cam chains 62A and 62B, tensioner lifters 83A and 83B come into abutment against the chain tensioners 81A and 81B in the first and second banks 23A, 23B from the side opposite to the cam chains 62A and 62B. The tensioner lifters 83A and 83B are provided, respectively, in the cylinder heads 19A and 19B of both banks 23A and 23B.

More specifically, the tensioner lifter 83A in the first bank 23A is provided in the first cylinder head 19A at the portion corresponding to the outside of both banks 23A and 23B, while the tensioner lifter 83B in the second bank 23B is provided in the second cylinder head 19B at the portion corresponding to the inside of both banks 23A and 23B.

The tensioner lifter 83A and 83B, which are of a conventional type, are provided with cylindrical cases 84A and 84B and push rods 85A and 85B projecting from one end of the cases 84A and 84B and urged in the projecting directions. The cases 84A and 84B are fitted in mounting holes 87A and 87B in such a manner that the tips of the push rods 85A and 85B are put in contact with the outer peripheries of the cam chains 62A and 62B, the mounting holes 87A and 87B being formed in the first and second cylinder heads 19A and 19B, respectively. Flanges 86A and 86B project radially outwardly from intermediate positions of the cases 84A and 84B, respectively, and are clamped to the first and second cylinder heads 19A and 19B, respectively.

The distance LA from the upper-end joining surface 22A of the first cylinder head 19 to the tensioner lifter 83A on the first bank 23A side is set shorter than the distance LB from the upper-end joining surface 22B of the second cylinder head 19B to the tensioner lifter 83B on the second bank 23B side.

The projecting portion of the tensioner lifter 83B projecting from the second cylinder head 19B in the second bank 23B is inclined so as to approach the upper-end joining surface 22B of the second cylinder head 19B as it extends outwardly, while the projecting portion of the tensioner lifter 83A projecting from the first cylinder head 19A in the first bank 23A is inclined so as to become more distant from the upper-end joining surface 22A of the first cylinder head 19A as it extends outwardly.

Referring to FIGS. 9 to 12, a pump unit 93 including a feed pump 91 and a scavenging pump 92 both having a common oil pump shaft 90 is disposed in a lower portion of the transmission chamber 27. A pump housing 94 of the pump unit 93 is mounted from below to the partition wall 28 provided in the crank case 17.

The pump housing 94 includes a housing body 95 and first and second covers 96, 97 which hold the housing body 95 grippingly from both sides and which are clamped with a plurality of bolts 98. A mounting portion 95*a*, which is integral with the housing body 95 and extends upwardly, is secured to the partition wall 28. The oil pump shaft 90 extends rotatably through the pump housing 94. A driven sprocket 99 for the pump is fixed to one end portion of the oil pump shaft 90. Further, an endless chain 101 is wound on both a driving sprocket 100 for the pump and the driven sprocket 99 for the pump. The driving sprocket 100 is supported by the main shaft 31 outside the crank case 17 so as to rotate together with the primary driven gear 42. Thus, the feed pump 91 and the scavenging pump 92 are driven with power transmitted thereto from the crank shaft 16.

The feed pump 91 and the scavenging pump 92 are trochoid pumps. In the feed pump 91, an inner rotor 102 fixed to the oil pump shaft 90 and an outer rotor 103 meshing with the inner rotor 102 are accommodated between the housing body 95 and the first cover 96. In the scavenging pump 92, an inner rotor 104 fixed to the oil pump shaft 90 and an outer rotor 105 meshing with the inner rotor 104 are accommodated between the housing body 95 and the second cover 97.

A suction passage 106 for the suction of oil into the feed pump 91 is formed in the first cover 96 in the pump housing 94. At least an upstream portion of the suction passage 106 is formed so as to extend vertically and an upstream end of the suction passage 106 is open to a lower end of the first cover 96 so as to open downward.

The feed pump 91 sucks oil present in the interior of the oil pan 25 through an oil strainer 107 disposed within the oil pan 25. The oil strainer 107 is connected to the suction passage 106.

A casing 108 of the oil strainer 107 includes a pair of upper and lower members joined together. The casing 108 includes a flat casing body 108*a*, a connecting pipe portion 108*b* extending upwardly from the casing body 108*a*, and a suction pipe portion 108*c* extending downwardly from the casing body 108*a* so as to become smaller in diameter downwardly and is provided at a lower end thereof with a suction port 110. A lower portion of the casing 108 is formed in the shape of a funnel.

An upper end of the connecting pipe portion 108*b* is fitted in the upstream end of the suction passage 106 through an annular sealing member 109. An upper end portion of the casing 108 is supported by the first cover 96 of the pump housing 94 which is attached to the partition wall 28 of the crank case 17. That is, the lower portion of the casing 108 whose upper end portion is supported on the crank case 17 side through the pump housing 94 is formed in the shape of a funnel and the suction port 110 is formed in the lower end of the casing 108.

Figure 10:
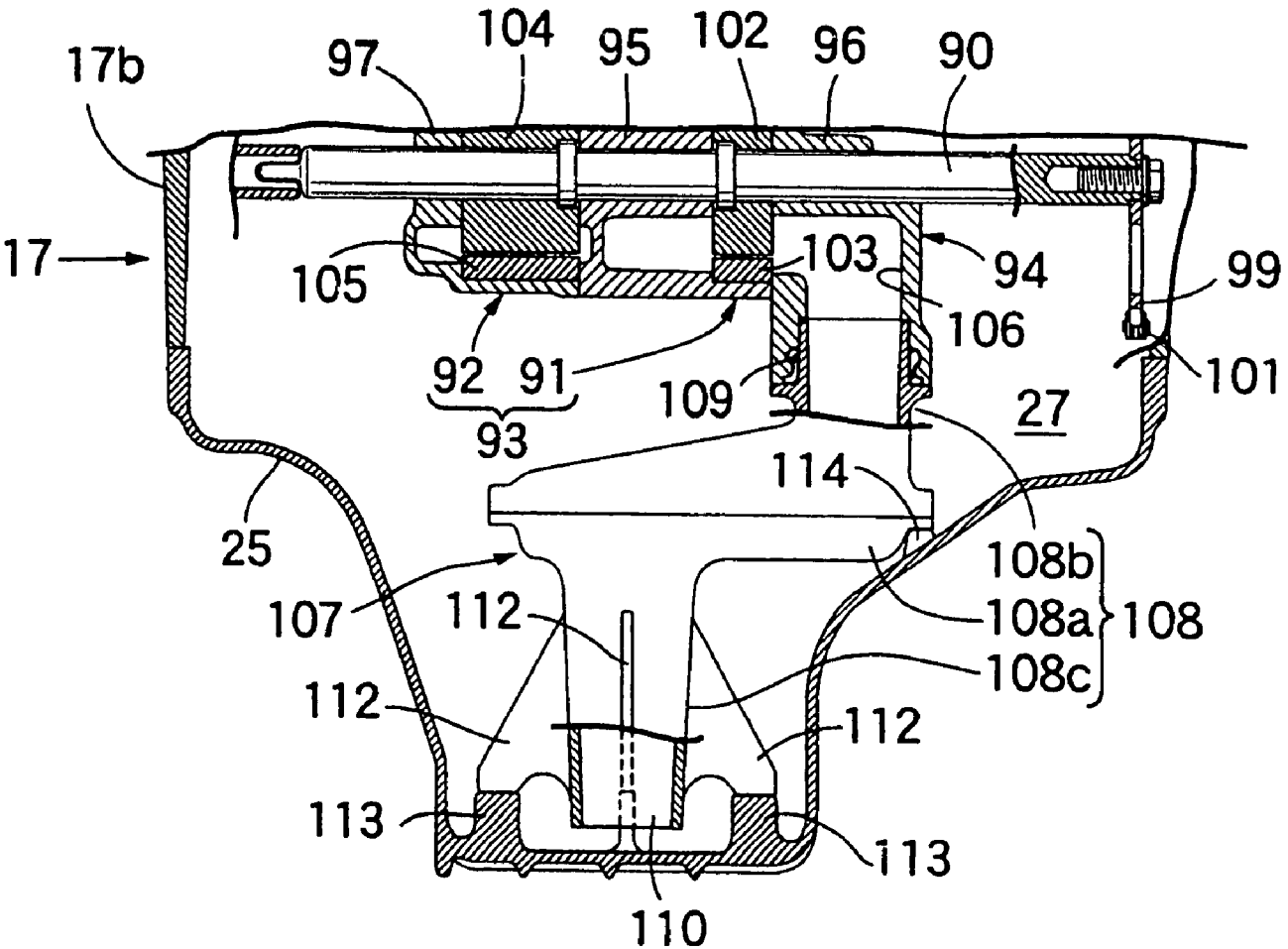
FIG. 10 is an enlarged sectional view taken on line 10-10 in FIG. 1.

As shown in FIG. 10, both right and left sides of the oil pan 25 are formed in a generally V-shape whose lower portion is narrow when looking from the rear side in the motorcycle advancing direction. In the casing 108 of the oil strainer 107, the casing body 108*a* and the connecting pipe portion 108*b* are positioned close to the right side wall of the oil pan 25 when looking from the rear side in the motorcycle advancing direction, and the suction pipe portion 108*c* is disposed nearly centrally in the transverse direction of the oil pan 25.

A plurality of, say, four, strainer support portions 112 are integrally formed on a side face of the suction pipe portion 108*c* in the lower portion of the casing 108. The strainer support portions 112 are formed in a vertically long slope shape so as to become larger in the amount of the projection from the casing 108 toward the lower side. The strainer support portions 112 are abutted against and supported by support projections 113 projecting from the bottom of the oil pan 25.

The strainer support portions 112 are formed integrally with the casing 108 so as to be disposed at least partially between both right and left sides of the casing 108 and both right and left sides of the oil pan 25 when looking from the motorcycle advancing direction. In this first embodiment, a pair of strainer support portions 112 are disposed right and left of the suction pipe portion 108*c* so as to be perpendicular to the motorcycle advancing direction, while the remaining pair of strainer support portions 112 are disposed before and behind the suction pipe portion 108*c*.

A support projection 114 abutted against a lower portion on the right side of the casing body 108*a* in the casing 108 integrally projects from the right side wall of the oil pan 25.

Figure 11:
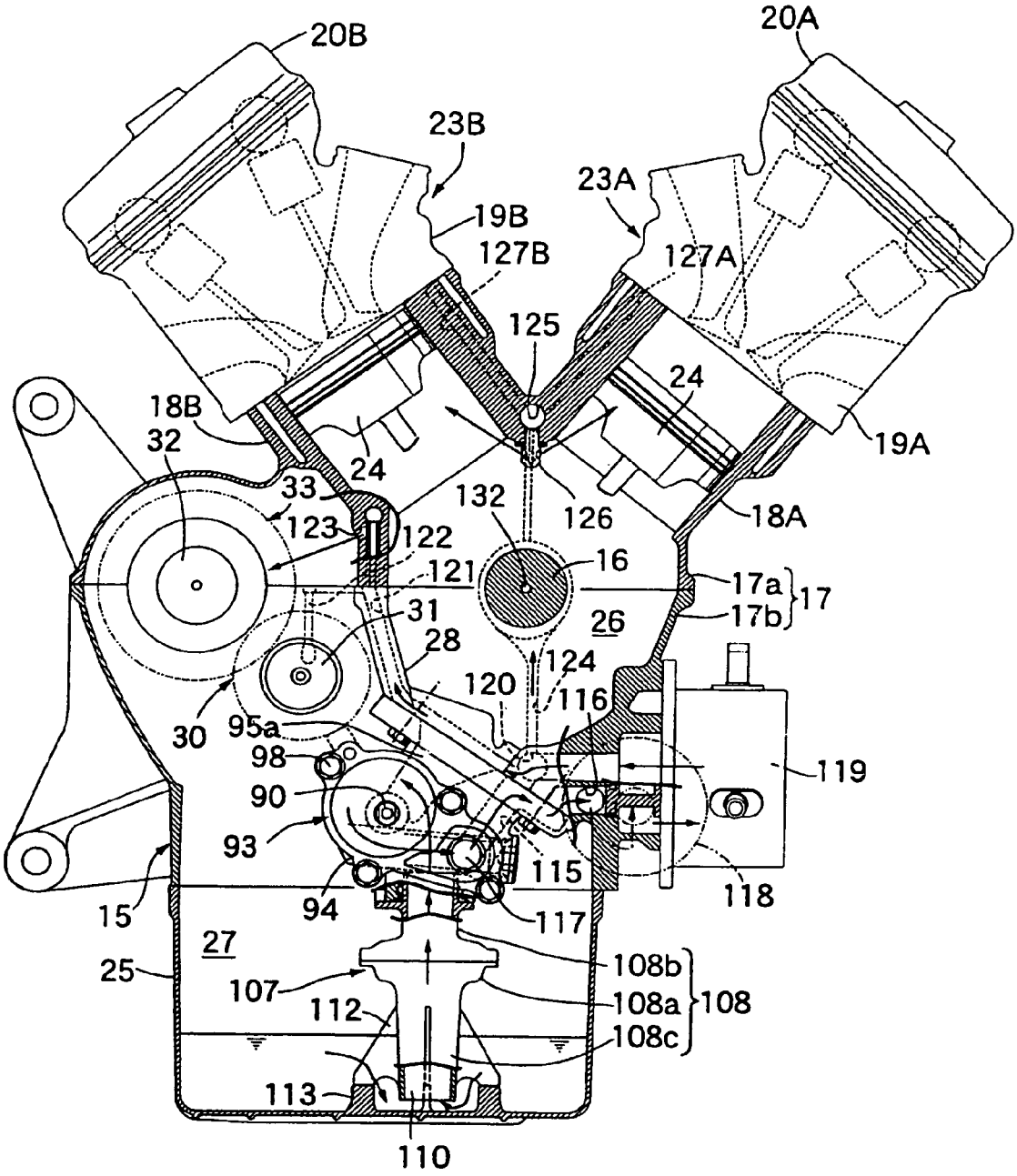
FIG. 11 is a vertical sectional view of an engine body as seen in the same direction as FIG. 1 for showing a flow of oil created by a feed pump.
Figure 12:
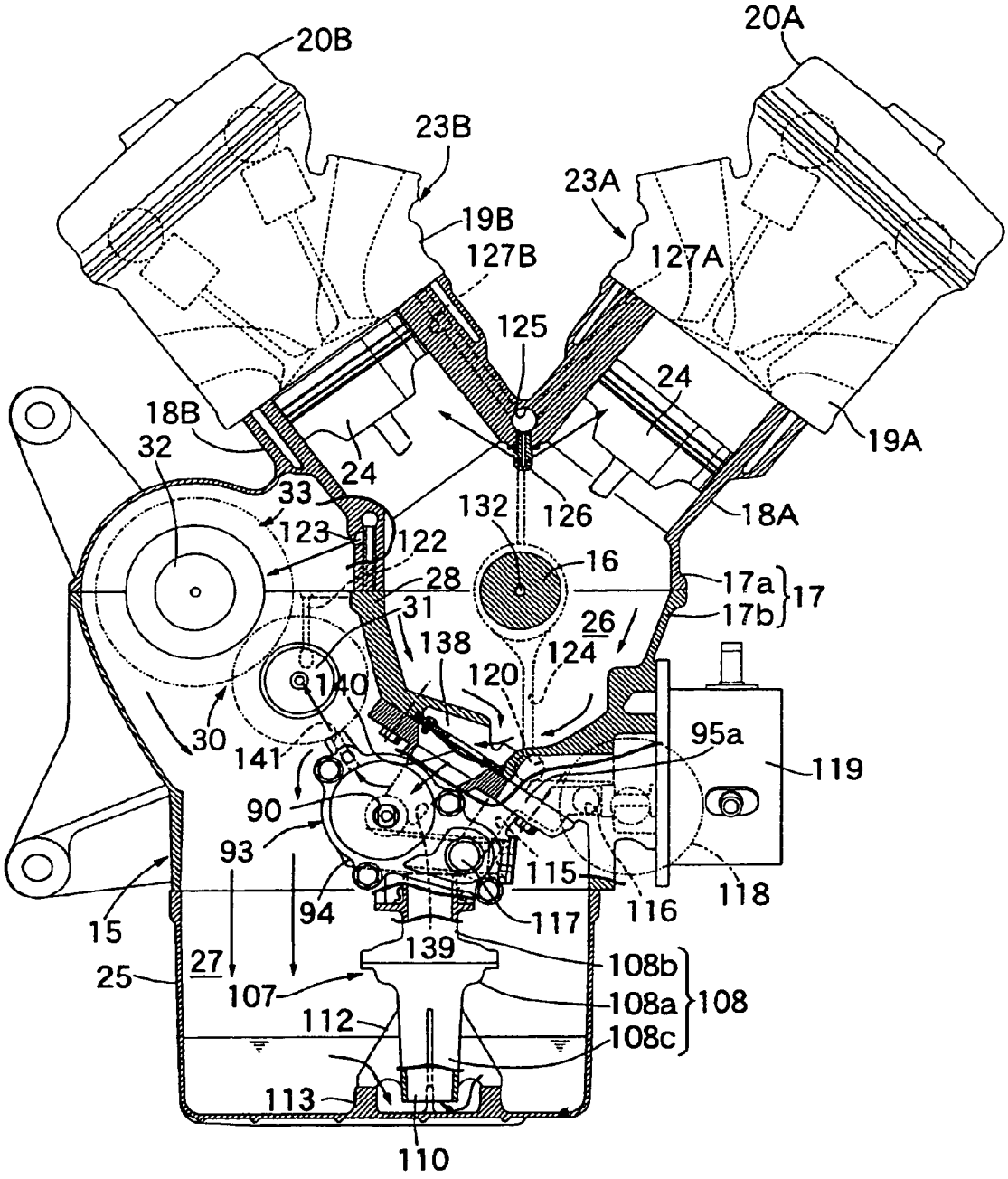
FIG. 12 is a vertical sectional view of the engine body corresponding to FIG. 11 for showing a flow of oil created by a scavenging pump.

Referring to FIGS. 11 and 12, a discharge passage 115 for the discharge of oil from the feed pump 91 is formed in the housing body 95 of the pump housing 94. The discharge passage 115 is put in communication with an oil passage 116 formed in the partition wall 28 of the crank case 17. Moreover, a relief valve 117 having an axis parallel to the oil pump shaft 90 is disposed between the casing body 95 of the pump housing 94 and the first cover 96 so as to become open when the discharge pressure of the discharge passage 115 has become a predetermined value or higher, allowing a portion of the oil flowing through the discharge passage 115 to escape to the suction side of the feed pump 91.

As indicated with arrows in FIG. 11, the oil flowing through the oil passage 116 formed in the partition wall 28 passes through an oil filter 118 attached to the crank case 17 and is purified thereby, then is introduced into an oil cooler 119 attached to the crank case 17 and is cooled thereby.

A main gallery 120 extending in parallel with the crank shaft 16 is provided in the partition wall 28 and the oil introduced into the main gallery 120 from the oil cooler 119 is branched into two. One oil portion is conducted to an oil passage 121 formed in the partition wall 28, then passes through an oil passage 122 and is fed to the shaft support portions of the gear train group 33 for the main shaft 31 and the counter shaft 32 in the gear transmission 30. Further, the oil is jetted towards the gear transmission 30 from a nozzle 123 which is provided in the crank case 17 so as to face the upper portion of the transmission 27.

The other oil portion branched from the main gallery 120 is fed upwardly from a plurality of oil passages 124 formed in the crank case 17 and is used for lubrication of a plurality of bearing portions which support the crank shaft 16. The oil passages 124 are in communication with an upper oil gallery 125 which is provided in an upper portion of the crank case 17 so as to extend in parallel with the crank shaft 16 at the joined portion between both banks 23A and 23B. The oil in question is jetted toward the pistons 24 in the cylinders in both banks 23A and 23B from nozzles 126 connected to the oil gallery 125. Oil passages 127A and 127B for conducting oil from the upper oil gallery 125 to a valve operating mechanism disposed between the cylinder heads 19A, 19*b* and the head covers 20A, 20B are formed in the cylinder blocks 18A, 18B and the cylinder heads 19A, 19B in the first and second banks 23A, 23B.

As shown clearly in FIG. 6, a cylindrical portion 128 projecting to the crank shaft 16 side is integrally provided on an inner surface of the right cover 76 at the portion corresponding to one end portion of the crank shaft 16, and a bolt 129 having a cylindrical portion 129*a* projecting into the cylindrical portion 128 is threadedly engaged coaxially with one end portion of the crank shaft 16. Further, an annular sealing member 130 is interposed between the cylindrical portions 128 and 129*a*. An oil chamber 131 sealed with the annular sealing member 130 is formed within the cylindrical portion 128 in such a manner that an end portion of the cylindrical portion 129*a* faces the oil chamber. Oil from the main gallery 120 is fed to the oil chamber 131 through an oil passage (not shown).

Moreover, a communication passage 133 is coaxially formed in the bolt 129 to provide communication of an internal oil passage 132 formed in the interior of the crank shaft 16 with the oil chamber 131. The oil introduced into the internal oil passage 132 is used for lubrication between large end portions of the crank pins 16*a* and the connecting rods 29 provided on the crank shaft 16.

Referring to FIG. 12, an oil collection hole 138 for the collection of oil dropped to a lower portion in the interior of the crank chamber 26 is formed in a lower portion of the partition wall 28 so as to communicate with a lower portion of the crank chamber 26. The crank chamber 26 is partitioned into a portion corresponding to the cylinders at one end in the cylinder arranged direction in the first and second banks 23A, 23B, a portion corresponding to the cylinders at the opposite end in the cylinder arranged direction in the first and second banks 23A, 23B and a portion corresponding to the central cylinder in the cylinder arranged direction in the first bank 23A. The oil collection hole 138 is formed in the lower portion of the partition wall 28 at every partitioned portion of the crank chamber 26. On the other hand, a suction passage 139 for the suction of oil into the scavenging pump 92 is formed in the housing body 95 correspondingly to the oil collection hole 138. The housing body 95 is integrally provided with the mounting portion 95*a* which is secured to the partition wall 28 in the pump housing 94.

Moreover, a reed valve 140 which permits only the flow of oil from the oil collection hole 138 to the suction passage 139 is disposed between the oil collection hole 138 communicating with the portion corresponding to the central cylinder in the arranged direction of cylinders in the first bank 23A and the suction passage 139 formed in the housing body 95.

A discharge passage 141 for the oil discharged from the scavenging pump 92 is formed in the second cover 96 in the pump housing 94. The discharge passage 141 is formed in the second cover 96 so as to discharge oil from a downstream end thereof toward the gear transmission 30.

Figure 9:
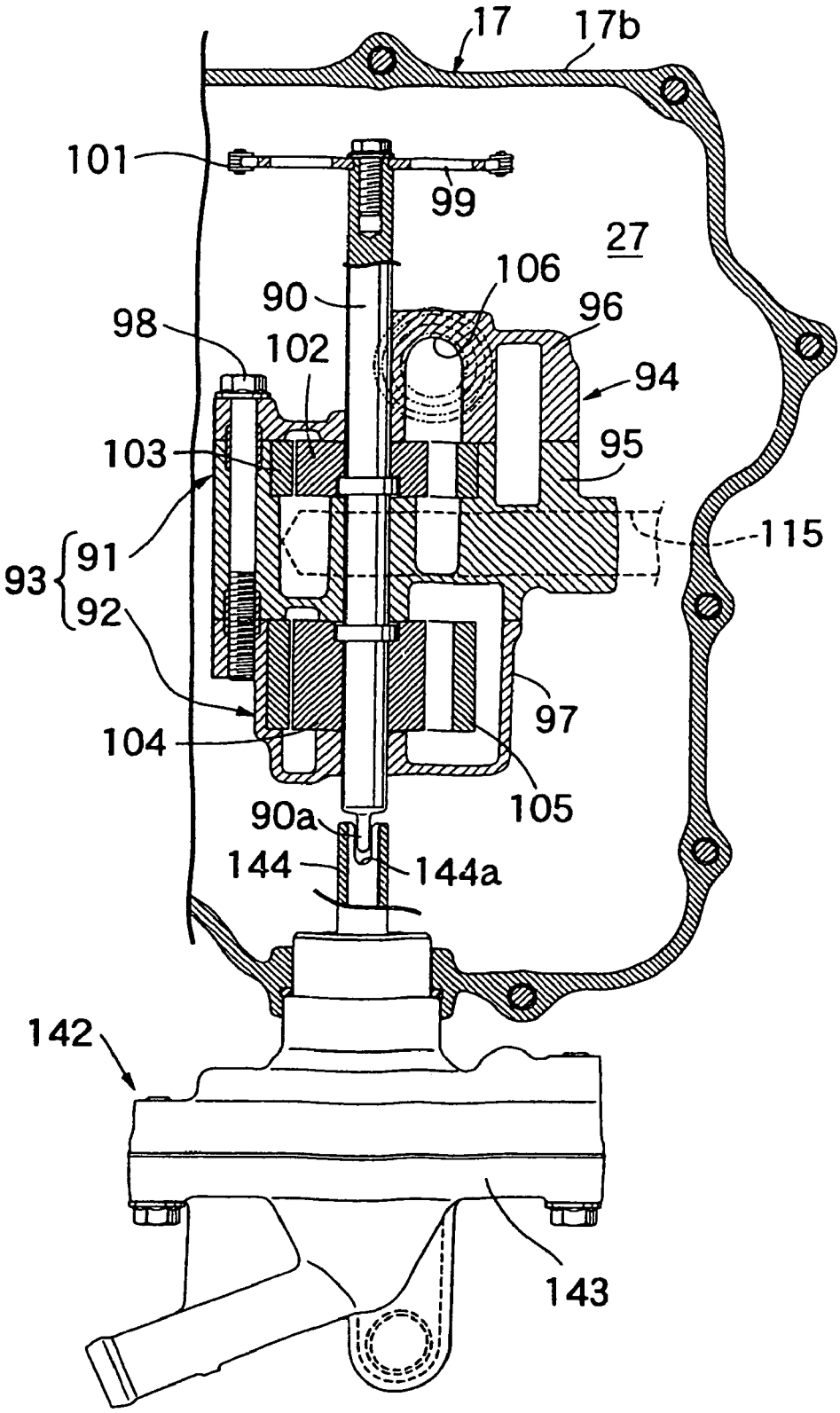
FIG. 9 is an enlarged sectional view taken on line 9-9 in FIG. 1.

Referring to FIG. 9, a pump case 143 of the water pump 142 is attached to the left side wall of the crank case 17 at the portion corresponding to the pump unit 93. A water pump shaft 144 of the water pump 142 is disposed coaxially with the oil pump shaft 90 of the pump unit 93 in such a manner that one end thereof projects from the pump case 143. In addition, a projection 90*a* projecting from the opposite end of the oil pump shaft 90 is engaged disengageably with an engaging recess 144*a* formed in one end of the water pump shaft 144. That is, the feed pump 91 and the scavenging pump 92 in the pump unit 93 are actuated with power transmitted thereto from the crank shaft 16 and the water pump 142 is also actuated with the power transmitted thereto from the crank shaft 16.

The following description is now provided about the operation of this embodiment. The intake-side and exhaust-side driven sprockets 59A, 60A are mounted on the intake-side and exhaust-side cam shafts 56A, 58A which are for opening and closing the intake valves 51A and exhaust valves 52A in the first bank 23A. The endless cam chain 62A is wound on the driving sprocket 61A on the first bank side adapted to rotate together with the idle gear 65 to which the power from the crank shaft 16 is transmitted and is also wound on the intake-side and exhaust-side cam shafts 56A, 58A. The intake-side and exhaust-side driven sprockets 59B, 60B are mounted on the intake-side and exhaust-side cam shafts 56B, 58B which are for opening and closing the intake valves 51B and exhaust valves 52B in the second bank 23B. Further, the endless cam chain 62B is wound on the driving sprocket 61B on the second bank side which sprocket is adapted to rotate together with the idle gear 65 and is also wound on the intake-side and exhaust-side cam shafts 56B, 58B. On the crank shaft 16 are mounted the primary driving gear 41 which transmits the engine power to the gear transmission 30 and the idler driving gear 64 which is formed smaller in diameter than the primary driving gear 41 and which is disposed axially outwardly with respect to the primary driving gear 42. The idle gear 65 meshing with the idler driving gear 64 is supported rotatably on the idle shaft 66 which has an axis parallel to the crank shaft 16 and which is supported by the crank case 17 of the engine body 15. The driving sprockets 61A and 61B on the first and second banks are coaxially contiguous to the idle gear 65 on the axially inner side of the idle gear in such a manner that at least a part of its outer periphery is opposed to the primary driving gear 41.

That is, the idle gear 65 is brought into mesh with the idler driving gear 64 of a smaller diameter than the primary driving gear 41 of a relatively large diameter which is mounted on the crank shaft 16. Further, the sprockets 61A and 61B on the first and second bank side are coaxially contiguous to the idle gear 65 on the axially inner side of the idle gear so that their outer peripheries are opposed at least partially to the primary driving gear 64. Consequently, it is possible to shorten the distance between the crank shaft 16 and the idle shaft 66 and make contribution to the reduction in size of the V-type engine.

Moreover, since the primary driven gear 42 engaged with the primary driving gear 41 is disposed at a position opposed to the outer periphery of the idler driving gear 64 and is connected to the clutch 34 which is disposed between the crank shaft 16 and the gear transmission 30, the crank shaft 16 and the clutch 34 can be disposed in proximity to the crank shaft 16 and it is possible to shorten the center distance between the axis of the clutch 34 and the crank shaft 16 and make a further contribution to the reduction in size of the V-type engine.

The driving sprocket 61A on the first bank 23A side, the driven sprocket 59A on the intake side, the exhaust-side driven sprocket 60A and the cam chain 62A, as well as the driving sprocket 61B on the second bank 23B side which forms a V-shape together with the first bank 23A, the intake-side driven sprocket 59B, the exhaust-side driven sprocket 60B and the cam chain 62*b*, are disposed in a mutually adjacent manner on one axial end side of the crank shaft 16, and the driving sprockets 61A and 61B for the first and second banks are formed integrally with the idle gear 65 which is a single gear common to both driving sprockets 61A and 61B. Therefore, it is possible to make a contribution to a reduction in the size of the V-type engine in the axial direction of the crank shaft 16 and attain a reduction in the number of engine parts.

The idle shaft 66 having the offset shaft portion 66*a* is supported so that its position about an axis offset from the axis of the offset shaft portion 66*a* can be adjusted, and the idle gear 65 is supported rotatably by the offset shaft portion 66*a* through the needle bearings 67. Therefore, while the backlash between the idler driving gear 64 and the idle gear 65 can be diminished by adjusting the rotational axis of the idle gear 65, it is possible to prevent an increase in size of the driving sprockets 61A and 61B on the first and second bank side and the idle gear 65 and further shorten the center distance between the idle shaft 66 and the crank shaft 16.

In the first and second banks 23A, 23B, the tensioner lifters 83A and 83B are brought into abutment against the chain tensioners 81A and 81B which are put in sliding contact with the cam chains 62A and 62B. The abutment of the tensioner lifters 83A and 83B against the chain tensioners 81A and 81B is performed from the side opposite to the cam chains 62A and 62B while imparting tension to the cam chains 62A and 62B. The tensioner lifters 83A and 83B are provided in the first and second cylinder heads 19A and 19B in the first and second banks 23A, 23B. One of both tensioner lifters 83A and 83B, which in this embodiment is the tensioner lifter 83A in the first bank 23A located on the front side in the motorcycle traveling direction, is provided in the first cylinder head 19A at the portion corresponding to the outside of both banks 23A and 23B. The other tensioner lifter 23B is provided in the second cylinder head 19B at the portion corresponding to the inside of both banks 23A and 23B. Further, the distance LA from the upper-end joining surface 22A of the first cylinder head 19A up to one tensioner lifter 83A is set smaller than the distance LB from the upper-end joining surface 22B of the second cylinder head 19B up to the other tensioner lifter 83B.

Therefore, the tensioner lifter 83B provided in the second cylinder head 19B at the portion corresponding to the inside of both banks 23A and 23B can be disposed at as low a position as possible, whereby it is possible to minimize the dead space between both banks 23A and 23B.

Since the projecting portion of the other tensioner lifter 83B projecting from the second cylinder head 19B is disposed to be inclined so as to approach the upper-end joining surface 22B of the second cylinder head 19B, not only it is possible to further diminish the dead space between both banks 23A and 23B, but also it is possible to facilitate mounting of the tensioner lifter 83B to the second cylinder head 19B from above and improve the mounting performance.

Further, since the projecting portion of one tensioner lifter 83A projecting from the first cylinder head 19A is disposed to be inclined away from the upper-end joining surface 22A of the first cylinder head 19A. Thus, not only it is possible to suppress the projection of the tensioner lifter 83A disposed outside both banks 23A and 23B from the first cylinder head 19A and thereby make a contribution to a reduction in the size of the engine, but also it is possible to ensure a mounting space of auxiliary devices disposed around the engine.

The oil pan 25 for the storage of oil to be fed to various portions of the engine body 15 is provided in the lower portion of the crank case 17. The upper end portion of the casing 108 of the oil strainer 107 disposed within the oil pan 25 is supported on the crank case 17 side. The suction port 110 is formed in the lower end of the casing 108 whose lower portion is formed in a funnel shape. A plurality of vertically long plate-like strainer support portions 112 are integrally formed on the lower side face of the casing 108 of the oil strainer 107 and are each abutted against and supported by the bottom of the oil pan 25.

Therefore, each strainer support portion 112 is allowed to fulfill the function of a reinforcing rib, whereby it becomes possible to enhance the strength of the lower portion of the casing 108. In addition, it is not necessary to specially enhance the support strength of the crank case 17 side which supports the upper end portion of the oil strainer 107. Also, it is possible to enhance the support strength of the oil strainer 107. Thus, the oil strainer 107 can be supported strongly while avoiding an increase in size and weight of the engine and an increase in the number of parts used. Moreover, each strainer support portion 112 fulfills the function of a partition wall which restricts the movement of oil within the oil pan 25, so that, within the oil pan 25, it is not necessary to dispose a partition wall in any other portion than the oil strainer 107, whereby it is also possible to reduce the number of parts used.

Since each strainer support portion 112 is formed so that the amount of its projection from the casing 108 becomes larger toward the lower side, it is possible to effectively uniform the flow of oil in the vicinity of the suction port 110. Thus, it is possible to keep the suction resistance of oil low to the suction port 110 and improve the suction efficiency.

Since the strainer support portions 112 are disposed in a pair in each of longitudinal and transverse directions of the motorcycle, the movement of oil within the oil pan 25 upon sudden acceleration or deceleration of the motorcycle and the movement of oil within the oil pan 25 with a transverse motion of the motorcycle can be restricted effectively by the strainer support portions 112.

Further, since the oil pan 25 is formed in a generally V-shape having a narrow lower portion when looking in the motorcycle advancing direction and a pair of strainer support portions 112 are disposed between the right and left side walls of the generally V-shaped oil pan 25 with a narrow lower portion and the oil strainer 107, it is possible to effectively prevent the oil from moving back and forth upon sudden acceleration or deceleration of the motorcycle.

Figure 13:
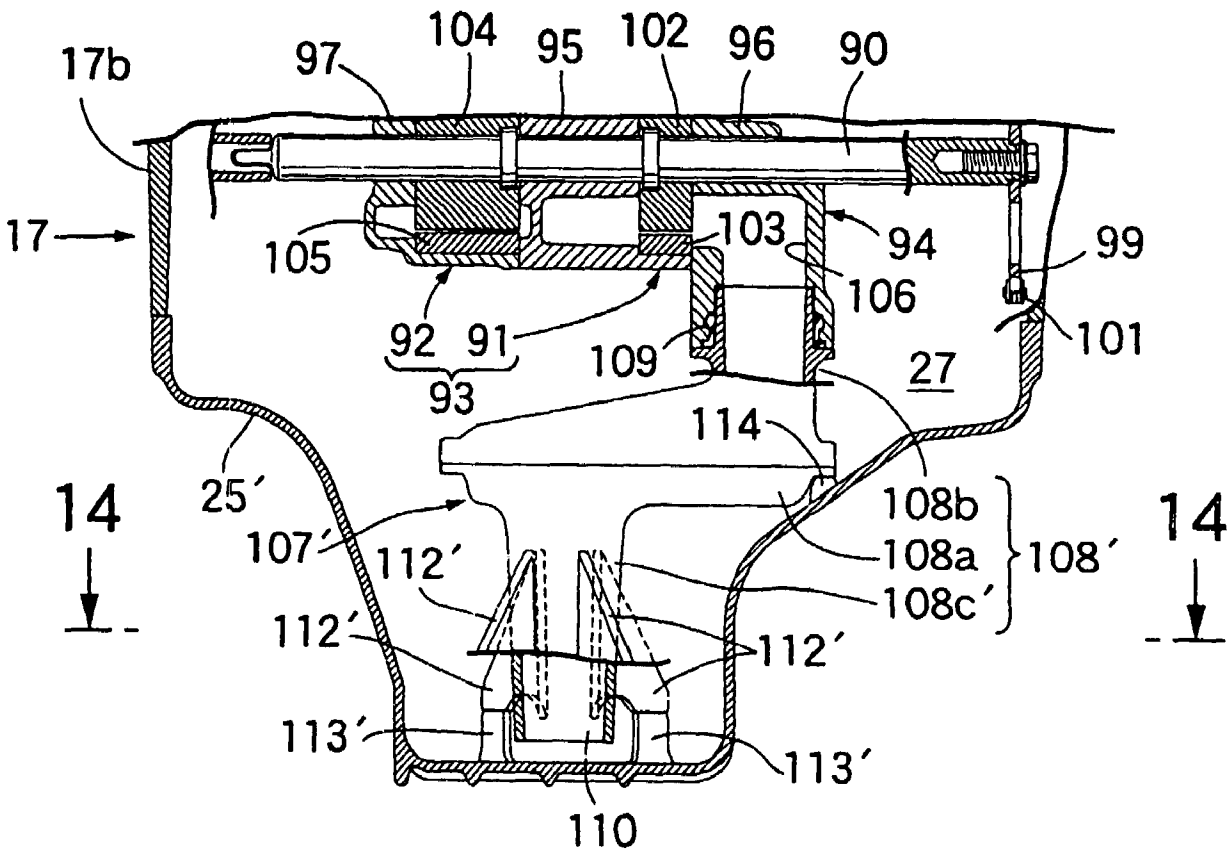
FIG. 13 is a sectional view illustrating a second embodiment of the present invention and corresponding to FIG. 10 of the first embodiment.
Figure 14:
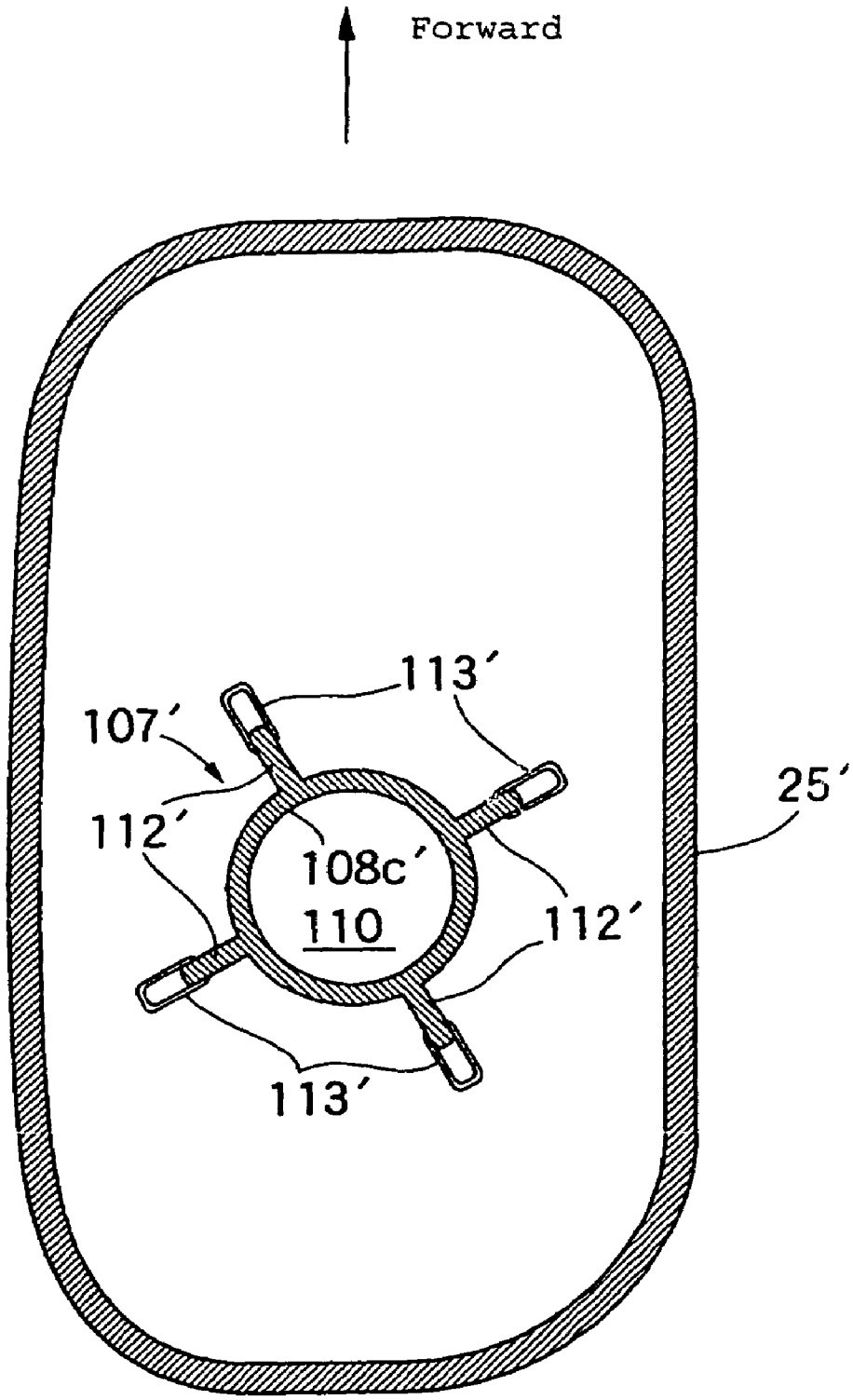
FIG. 14 is a sectional view taken on line 14-14 in FIG. 13.

FIG. 13 is a sectional view illustrating a second embodiment of the present invention and corresponding to FIG. 10 of the first embodiment. FIG. 14 is a sectional view taken on line 14-14 in FIG. 13. In these figures, the portions corresponding to those in the first embodiment are identified by the same reference numerals as in the first embodiment and are illustrated only, with a detailed description thereof being omitted.

Both right and left sides of an oil pan 25' are formed in a generally V-shape having a narrow lower portion. A plurality of, say, four, strainer support portions 112' are formed integrally on a side face of a suction pipe portion 108*c*' in a lower portion of a casing 108' of an oil strainer 107'. The strainer support portions 112' are each formed in a vertically long plate shape so as to become larger in the amount of projection from the casing 108' toward the lower side. The strainer support portions 112' are abutted against and supported by support projections 113' projecting on the bottom of the oil pan 25'.

In addition, the strainer support portions 112' are formed integrally with the casing 108' so as to be positioned at least partially between both the right and left sides of the casing 108' and both the right and left sides of the oil pan 25' when looking in the motorcycle advancing direction. In this second embodiment, the strainer support portions 112' are integrally formed at equal intervals in the circumferential direction on the side face of the casing 108' so as to intersect the motorcycle advancing direction at an angle of 30° for example. The strainer support portions 112' provided in a pair on each of the right and left sides are formed integrally on the side face of the casing 108' so as to be partially positioned between both the right and left sides of the casing 108' and both the right and left sides of the oil pan 25'. The crossing angle of the strainer support portions 112' relative to the motorcycle advancing direction may be set arbitrarily, for example at 45°.

According to this second embodiment, the strainer support portions 112' are disposed in a pair between both the right and left sides of the casing 108' and also in a pair between both the right and left sides of the oil pan 25', whereby the oil can be prevented more effectively from moving back and forth with sudden acceleration or deceleration of the motorcycle. The strainer support portions 112' are abutted against and supported by support projections 113' projecting from the bottom of the oil pan 25'.

Although embodiments of the present invention have been described above, the present invention is not limited to the above embodiments, but various design changes may be made without departing from the present invention described in the scope of claims.

For example, although in the above embodiments the present invention is applied to a V-type engine, the present invention is widely applicable to other engines other than the V-type engine and is further applicable to engines mounted on other vehicles other than the motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil strainer support structure in an engine wherein an oil pan for the storage of oil to be fed to various portions of an engine body is joined to a lower portion of a crank case provided in an engine body, an upper end portion of a casing of an oil strainer disposed within the oil pan is supported on the crank case side, and a suction port is formed in a lower end of said casing having a lower portion being formed in the shape of a funnel comprising:

a plurality of vertically long plate-shaped strainer support portions integrally formed on a side face of the lower portion of said casing and each of said plurality of vertically long plate-shaped strainer support portions being abutted against and supported on upper surfaces of a plurality of projecting projection from a bottom of said oil pan.

2. The oil strainer support structure in an engine according to claim 1, wherein said plurality of vertically long plate-shaped strainer support portions are substantially triangular in shape, and are formed so as to become larger in the amount of projection from said casing toward the lower side.

3. The oil strainer support structure in an engine according to claim 1, wherein said strainer support portions are disposed in a pair in the longitudinal direction of a vehicle on which an engine body is mounted and also in a pair in the transverse direction of a vehicle.

4. The oil strainer support structure in an engine according to claim 2, wherein said strainer support portions are disposed in a pair in the longitudinal direction of a vehicle on which an engine body is mounted and also in a pair in the transverse direction of a vehicle.

5. The oil strainer support structure in an engine according to claim 1, wherein both right and left sides of said oil pan are formed in a generally V-shape having a narrow lower portion when looking in an advancing direction of a vehicle on which an engine body is mounted, and a plurality of strainer support portions are integrally formed on a side face of the lower portion of said casing, said strainer support portions including at least such strainer support portions as are disposed at least partially between both right and left sides of said casing and both right and left sides of said oil pan.

6. The oil strainer support structure in an engine according to claim 2, wherein both right and left sides of said oil pan are formed in a generally V-shape having a narrow lower portion when looking in an advancing direction of a vehicle on which an engine body is mounted, and a plurality of strainer support portions are integrally formed on a side face of the lower portion of said casing, said strainer support portions including at least such strainer support portions as are disposed at least partially between both right and left sides of said casing and both right and left sides of said oil pan.

7. The oil strainer support structure in an engine according to claim 1, wherein said plurality of vertically long plate-shaped strainer support portions function as reinforcing ribs for enhancing the strength of the lower portion of the casing.

8. The oil strainer support structure in an engine according to claim 1, wherein the plurality of vertically long plate-shaped strainer support portions function as partition walls within the oil pan for restricting the movement of oil within the oil pan.

9. The oil strainer support structure in an engine according to claim 1, wherein four vertically long plate-shaped strainer support portions are provided with a first pair being perpendicular to a direction of motion of a vehicle and a second pair being substantially orthogonally disposed relative to said first pair.

10. The oil strainer support structure in an engine according to claim 1, wherein four vertically long plate-shaped strainer support portions are provided with a first pair being substantially at an angle in the range of 30° to 45° relative to a direction of motion of a vehicle and a second pair being substantially orthogonally disposed relative to said first pair.

11. An oil strainer support structure for use with an engine having an oil pan for the storage of oil to be fed to various portions of an engine body comprising:

a casing for the oil strainer;

an upper end portion of a casing being adapted to be supported on a crank case side of an engine;

a suction port of said casing being formed in a lower end of said casing; and a plurality of elongated strainer support portions integrally formed on a side face of a lower portion of said casing;

wherein each of said plurality of elongated strainer support portions being adapted to abut against and be supported by a bottom of an oil pan, wherein said strainer support portions are formed with side edges that are long and straight, and that slope vertically toward a lower side of said casing.

12. The oil strainer support structure according to claim 11, wherein lower edges of said strainer support portions abut against upper surfaces of a plurality of projections projecting upward from the bottom of the oil pan.

13. The oil strainer support structure according to claim 11, wherein said strainer support portions are disposed in a pair in the longitudinal direction of a vehicle on which an engine body is mounted and also in a pair in the transverse direction of a vehicle.

14. The oil strainer support structure according to claim 12, wherein said strainer support portions are disposed in a pair in the longitudinal direction of a vehicle on which an engine body is mounted and also in a pair in the transverse direction of a vehicle.

15. The oil strainer support structure according to claim 11, wherein both right and left sides of an oil pan are formed in a generally V-shape having a narrow lower portion when looking in an advancing direction of a vehicle on which an engine body is mounted, and a plurality of strainer support portions are integrally formed on a side face of the lower portion of a casing, said strainer support portions including at least such strainer support portions as are disposed at least partially between both right and left sides of a casing and both right and left sides of an oil pan.

16. The oil strainer support structure according to claim 12, wherein both right and left sides of an oil pan are formed in a generally V-shape having a narrow lower portion when looking in an advancing direction of a vehicle on which an engine body is mounted, and a plurality of strainer support portions are integrally formed on a side face of the lower portion of a casing, said strainer support portions including at least such strainer support portions as are disposed at least partially between both right and left sides of a casing and both right and left sides of an oil pan.

17. The oil strainer support structure according to claim 11, wherein said plurality of strainer support portions function as reinforcing ribs for enhancing the strength of the lower portion of the casing.

18. The oil strainer support structure according to claim 11, wherein the plurality of strainer support portions function as partition walls within an oil pan for restricting the movement of oil within an oil pan.

19. The oil strainer support structure according to claim 11, wherein four strainer support portions are provided with a first pair being perpendicular to a direction of motion of a vehicle and a second pair being substantially orthogonally disposed relative to said first pair.

20. The oil strainer support structure according to claim 11, wherein four strainer support portions are provided with a first pair being substantially at an angle in the range of 30° to 45° relative to a direction of motion of a vehicle and a second pair being substantially orthogonally disposed relative to said first pair.

* * * * *